United States Patent [19]

Williams

[11] 4,353,133

[45] Oct. 12, 1982

[54] SHOULDER PROTECTION DEVICE

[75] Inventor: Paul D. Williams, Davison, Mich.

[73] Assignee: Williams Gun Sight Co., Davison, Mich.

[21] Appl. No.: 113,464

[22] Filed: Jan. 21, 1980

[51] Int. Cl.[3] ..... A41D 13/00

[52] U.S. Cl. ..... 2/2; 2/45; 2/95; 2/268

[58] Field of Search ..... 2/2, 45, 94, 267, 268

[56] References Cited

U.S. PATENT DOCUMENTS

| | | | |
|---|---|---|---|
| 723,750 | 3/1903 | Stein | 2/151 |
| 811,167 | 1/1906 | Paddock | 2/92 |
| 849,266 | 4/1907 | Petmecky | 2/2 |
| 1,000,297 | 8/1911 | Sagerstrom | 2/2 |
| 1,587,946 | 6/1926 | Gibson | 2/2 |
| 2,063,469 | 12/1936 | Smith | 2/2 X |
| 2,589,636 | 3/1952 | Smith | 2/2 X |
| 2,948,899 | 8/1960 | Allen | 2/9 X |
| 2,986,738 | 6/1961 | Zubiate | 2/2 |
| 3,257,666 | 6/1966 | Hoffman | 2/2 |
| 3,452,362 | 7/1969 | Korolick et al. | 2/2.5 |
| 3,504,377 | 4/1970 | Biggs et al. | 2/2 |
| 3,801,984 | 4/1974 | Kanicki | 2/2 |
| 3,885,248 | 5/1975 | Salsby | 2/94 |
| 4,050,099 | 8/1977 | David | 2/46 |

FOREIGN PATENT DOCUMENTS

| | | | |
|---|---|---|---|
| 13924 | 6/1907 | United Kingdom | 2/2 |

*Primary Examiner*—Louis Rimrodt

*Attorney, Agent, or Firm*—Harness, Dickey & Pierce

[57] ABSTRACT

A strap retained shoulder protection device for absorbing loads directed to a user's shoulder area by reason of rifle or similiar firearm recoil. The device includes a shoulder protection pad and a strap assembly which cooperates with the pad to form a shoulder harness for locating and retaining the pad in its proper operative position upon the user's shoulder area. The strap assembly is adjustable to facilitate use of the device by different users. The protection pad may be provided with various amounts or load absorbent material according to the desires of the user.

2 Claims, 4 Drawing Figures

FIG. 1.
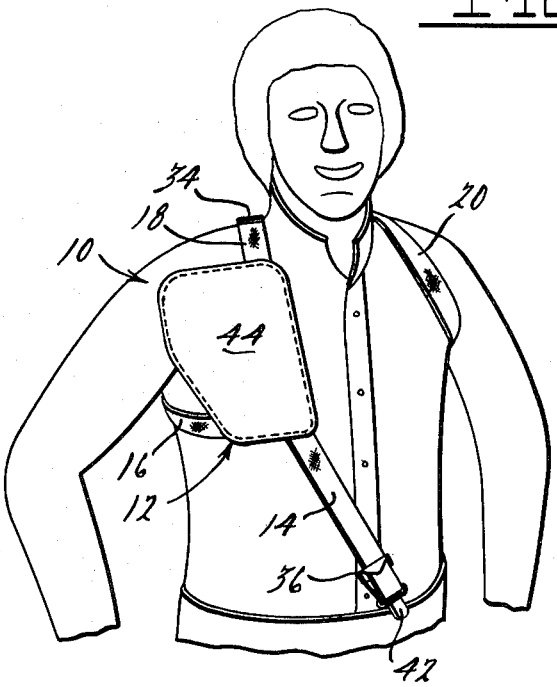
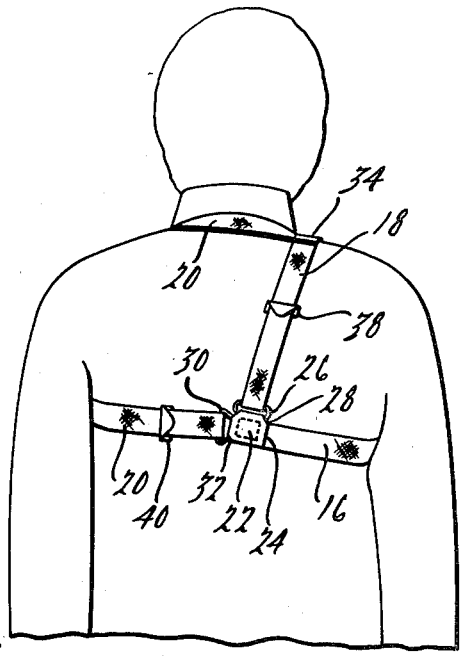
FIG. 2.
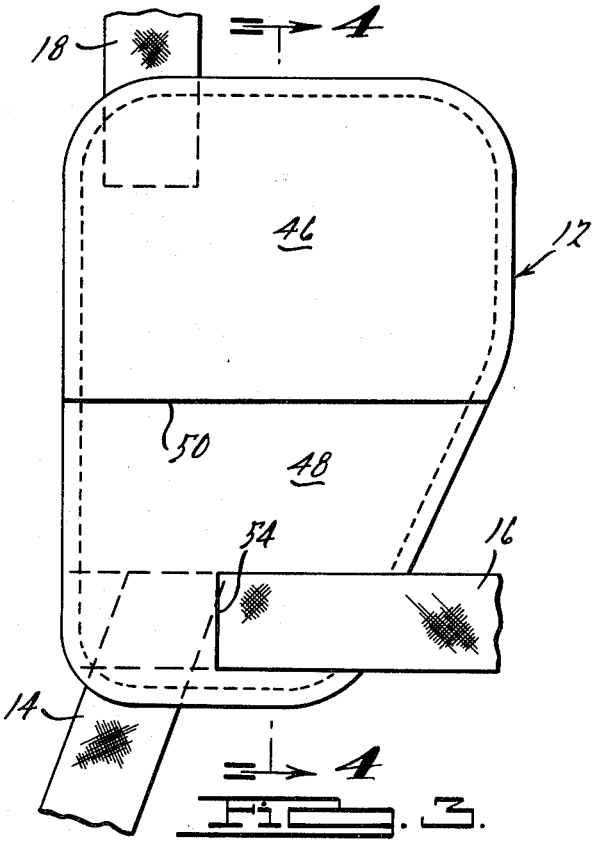
FIG. 3.
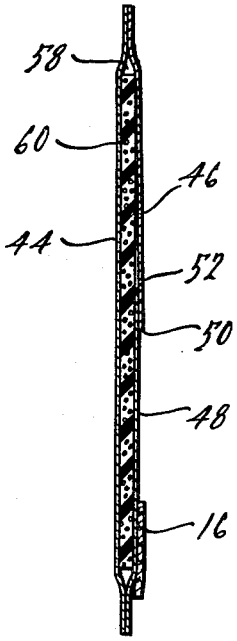
FIG. 4.

SHOULDER PROTECTION DEVICE

BACKGROUND AND SUMMARY OF THE INVENTION

The present invention relates to a lightweight adjustable strap retained shoulder protection device particularly suited to offer protection from gun or rifle recoil.

As is well known, continuous and repeated use of heavy shotguns and rifles can eventually become distressful, fatiguing and often painful for a marksman or hunter due to the unavoidable impact loads or forces directed to the shoulder area by reason of repeated gun recoil. For this reason, it is often desirable and necessary to provide the shoulder with some sort of protective padding or covering for at least partially absorbing such loads to enable the gun user to shoot with more comfort and with less fatigue.

Various outer garments and shooting or hunting vests have been devised to offer the wearer a means of protection against such recoil loads. However, while such prior articles may offer the wearer adequate recoil protection, they are often fairly heavy, cumbersome and clumsy. The weight and size of such garments make them somewhat ill-suited for use in warm or humid weather, and contribute to the wearer's fatigue. Additionally, such garments often lack versatility in that they may provide insufficient protection when worn during use of heavier gauged guns, or provide more protection than necessary when utilized with lighter gauged weapons. Moreover, as they often effectively comprise an outer garment or piece of clothing, a particular garment can be worn comfortably and effectively only by users of the same general shape and build. For these reasons, these prior articles are somewhat limited in their utility.

It is, therefore, desirable to provide a shoulder protection device which provides the user with adequate protection against gun recoil, yet which eliminates the bulk, weight and warmth associated with traditional shoulder protection devices. It is moreover desirable to provide such a device which is especially designed for ease of movement, as well as shooting in warm or humid weather. It is additionally desirable to provide such a device which may be worn by user's of different shapes and sizes. Finally, it is desirable to provide a shoulder protection device of the above type which may be adapted to offer varying amounts of shoulder protection in accordance with the desires of different users and the recoil capabilities of different weapons.

The present invention is intended to satisfy all of the above desirable features through the provision of a new and improved shooter's shoulder protection device comprising a relatively thin flexible protective pad and a plurality of lightweight flexible straps which cooperate with the pad to create a lightweight shoulder harness for locating and retaining the pad generally in the user's shoulder area and thereby function in effectively absorbing firearm recoil directed thereto. The protective pad is comprised of an outer envelope having an access opening through which varying amounts of load absorbent material may be removably inserted into the envelope. The strap assembly is adjustable to allow the device to be worn by different users. The device is designed for ease of movement and is particularly suited for warm weather shooting since it eliminates the disadvantages associated with traditional protective shooter's garments.

BRIEF DESCRIPTION OF THE DRAWINGS

FIG. 1 is a front perspective view of a shoulder protection device in accordance with the present invention as worn by a user thereof.

FIG. 2 is a rear perspective view of the user wearing the device as shown in FIG. 1.

FIG. 3 is a rear plan view of a portion of the device.

FIG. 4 is a sectional view taken in the direction of Line 4—4 of FIG. 3.

DETAILED DESCRIPTION OF THE PREFERRED EMBODIMENT

Referring now more specifically to the drawings, a strap retained shooter's shoulder protection device in accordance with one preferred embodiment of the present invention is indicated generally by reference numeral 10. The device 10 includes a pad means 12 which is operative to at least partially absorb a force directed thereto. The construction and function of pad means 12 will be described more fully hereinafter. Associated with pad means 12 is a means for retaining pad means 12 adjacent the right upper trunk or shoulder area of a user to allow pad means 12 to absorb part of a load directed to the shoulder area by reason of a gun or rifle recoil. As shown in FIGS. 1 and 2, this retaining means is comprised of preferably, but not necessarily four lightweight flexible strap members 14, 16, 18 and 20, respectively, which cooperate with pad means 12 to effectively create a shoulder harness assembly for locating and retaining pad means 12 generally in the area of a user's shoulder.

As shown in FIGS. 1 and 3, a first strap member 14 is affixed to pad means 12 at one end thereof and is operative to extend from pad means 12 generally diagonally across a user's lower trunk for attachment to a belt or pants. To accomplish this objective, strap member 14 is provided with a belt or pants attachment means 42 of a well known type. As shown in FIG. 1, attachment means 42 includes a ring member through which strap member 14 extends. Strap member 14 is also provided with a standard clip type sliding strap adjustment means 36 which cooperates with the ring member of attachment means 42 to allow strap member 14 to be lengthened or shortened according to the desires of the user.

A second strap member 16 is also affixed to pad means 12 at one end thereof and is adapted to extend circumferentially about the user's upper trunk below and substantially adjacent the right underarm area. As shown in FIGS. 1 and 2, strap member 16 extends from pad means 12 underneath the user's right arm and is of a length sufficient to locate its other end generally in the middle of the user's upper back. The third strap member 18 is also affixed to pad means 12 at one end thereof. Strap member 18 is operative to extend from pad means 12 up and over the user's right shoulder and is also of a length sufficient to locate its other end generally in the middle of the user's upper back area. The retaining means includes a fourth strap member 20 which is operative to extend from the user's upper back area circumferentially about the upper trunk underneath the left arm, up and over the left shoulder, and across the rear neck area.

The retaining means also includes means for operatively connecting strap members 16, 18 and 20 to allow them to cooperate with pad means 12 to thereby form a shoulder harness assembly. This connecting means includes a substantially rectangular connecting pad 22 located generally at the upper middle back of the user, and to which the end of strap member 16 is affixed so as to extend from edge 24 thereof. Associated with connecting pad 22 is a generally elongated ring member 26 receivably carried in a loop type recess 28 formed in connecting pad 22 and extending along a second edge thereof. A second ring member 30 is carried in a similarly shaped recess 32 extending along a third edge of connecting pad 22 opposite edge 24 thereof. As shown in FIG. 2, ring members 26 and 30 enable strap members 18 and 20, respectively, to be looped thereabout to enable them to be operatively connected to one another and to strap member 16 through the assembly formed by connecting pad 22 and ring members 26 and 30. These ring members also allow strap members 18 and 20 to be adjustably lengthened and shortened according to the desires of the user through the use of standard clip type sliding strap adjustment means 38 and 40 provided with each respective strap member. As shown in FIGS. 1 and 2, the connecting means is further comprised of a second connecting pad 34 to which strap members 18 and 20 are fixedly connected.

Pad means 12 is comprised of an envelope formed by the mated assembly of a relatively thin flexible and compliant front pad portion 44 and two flexible overlapping rear pad portions 46 and 48, respectively. As shown in FIGS. 3 and 4, pad portion 46 defines a shape similar to the upper part of pad portion 44 and is attached peripherally along three sides thereof to pad portion 44. Similarly, pad portion 48 defines a shape similar to the lower part of pad portion 44 and is likewise attached peripherally at three sides thereof to pad portion 44. However, the lower edge 50 of pad portion 46 and the upper edge 52 of pad portion 48 remain unattached to permit entry into the envelope through a slotted entry or access opening defined by the overlapping portions of pad portions 46 and 48, as shown generally in FIG. 4.

As so assembled, pad portions 44, 46 and 48 define an envelope having a recess 58 therewithin and an access opening to recess 58 defined by the overlapping edges 50 and 52 of pad portions 46 and 48, respectively. As shown in FIG. 4, this envelope is adapted to receivably retain a force or shock absorbent material 60 within recess 58. By reason of the access opening to recess 58, this shock absorbent material may be readily and easily inserted and removed from recess 58 at the desire of the user. As shown in FIG. 3, the envelope is also adapted to receive one end of strap member 16 through a slot 54 in pad portion 48 into the lower portion of recess 58. As can be seen from the drawings, the peripheral connections between pad portions 44, 46 and 48 are also operative to connect strap members 14, 16 and 18 to pad means 12.

In the preferred embodiment, pad portions 44, 46 and 48 are comprised of moisture proof velour suede leather. Strap members 14, 16, 18 and 20 are comprised of an elastic polyester webbing. The leather pad portions are connected at their peripheries to one another and strap members 14, 16 and 18 are affixed to pad means 12 by a glue reinforced stitching. Connecting pad 22 is comprised of a piece of full grain leather which is suitably shaped to allow it to be multiply folded to form recesses 28 and 32 for receiving ring members 26 and 30 respectively. Strap member 16 is attached to connecting pad 22 between these folds by a glue reinforced stitching. Connecting pad 34 is also comprised of a piece of full grain leather which is folded over strap members 18 and 20. The connection between these strap members and connecting pad 34 is also achieved by use of a glue reinforced stitching. Ring members 26 and 30, adjustment means 36, 38 and 40, and belt attachment means 42 are comprised of suitable brass hardware pieces. The shock absorbent material 60 of pad means 12 is comprised of suitable foam material adapted for gun recoil absorption. It is readily apparent that the above-described materials are of the preferred embodiment only and that other materials could also be utilized to achieve the objectives of the invention.

In order to utilize the shoulder protection device 10, the user slips his right arm through the loop formed by strap members 16 and 18. He may thereafter slip his left arm through the loop formed by strap members 18 and 20 and then attach strap member 14 to the top of his pants or belt. The device 10 may be adjusted to fit the size and comfort needs of the user by adjusting strap members 14, 18 and 20 as desired. It is readily apparent that this feature enables the device 10 to be utilized by many different users. Additionally, the access opening feature of pad means 12 enables the device 10 to be utilized with varying amounts of padding in accordance with the use of different weapons or according to the desires of different users.

The advantages of the present invention also include the provision of shoulder protection against rifle recoil without the unnecessary bulk, weight and warmth associated with traditional shooting vests. The present invention is therefore well suited for many warm weather shooting activities such as trap and skeet shooting, bench rest shooting, as well as hunting. While the device illustrated in the drawings is adapted for use by a right handed user, it is readily apparent that a similarly adapted device could provide protection for the shoulder of a left handed user.

It is understood that the foregoing description is that of the preferred embodiment of the invention and that various changes and modifications may be made thereto without departing from the spirit and scope of the invention, as defined in the appended claims.

What is claimed is:

1. A shoulder protection device comprising a lightweight flexible shoulder harness assembly and an energy absorbing flexible shoulder pad which is retained by said shoulder harness assembly adjacent the shoulder area along one side of the upper front chest of the user to protect said shoulder area against forces directed thereto, said shoulder harness assembly including a plurality of strap members which are operatively connected with one another and said shoulder pad to define a strap assembly extending solely about the upper back and around both shoulders of the user, said strap assembly defining a first loop assembly which extends about the upper trunk and around that shoulder of the user which defines said shoulder area, said first loop assembly including said shoulder pad, a first strap member attached to said shoulder pad and extending therefrom underneath the user's arm adjacent said shoulder area to the user's upper middle back area, a second strap member attached to said shoulder pad and extending therefrom over the shoulder defining said shoulder area to the user's upper middle back area, and a first means for connecting said first and second strap members to one another in the user's upper middle back area, said strap assembly further defining a second loop assembly which is connected to said first loop assembly and which extends solely along the uppper back and around the other shoulder of the user with no involvement of the upper front chest of the user opposite said one side, said second loop assembly including a third strap member which is operably connected at one end thereof to said first loop assembly by said first connecting means and which extends therefrom across the upper back, underneath the other arm, and up and across the back of the neck of the user to intersect said second strap member, and a second means for connecting said third strap member to said second strap member at the point where said second and third strap members intersect, with at least one of said strap members being length adjustable to enable the size of said strap assembly to be adjusted to allow the device to be worn by users of different shapes and sizes.

2. A shoulder protection device as set forth in claim 1 wherein each of said second and third strap members is length adjustable to enable the size of each of said first and second loop assemblies to be adjusted as desired.

* * * * *